US006360753B1

(12) United States Patent
Vickers

(10) Patent No.: US 6,360,753 B1
(45) Date of Patent: Mar. 26, 2002

(54) FLUID APPLICATOR

(76) Inventor: Karen W. Vickers, 1828 Sam Bruce Rd., Royston, GA (US) 30662

( * ) Notice: Subject to any disclaimer, the term of this patent is extended or adjusted under 35 U.S.C. 154(b) by 0 days.

(21) Appl. No.: 09/598,551

(22) Filed: Jun. 21, 2000

Related U.S. Application Data

(60) Provisional application No. 60/140,384, filed on Jun. 22, 1999.

(51) Int. Cl.[7] ..... A45D 34/04

(52) U.S. Cl. ..... 132/320; 401/6; 401/263; 15/244.1

(58) Field of Search ..... 132/320; 401/6, 401/265, 263, 261; 15/144.4, 104.94, 209.1, 244.1

(56) References Cited

U.S. PATENT DOCUMENTS

| | | | | |
|---|---|---|---|---|
| 1,973,768 A | | 9/1934 | Knapp | |
| 2,800,673 A | * | 7/1957 | Lazisky | 401/188 R |
| 3,103,682 A | * | 9/1963 | Markle | 15/244.1 |
| 3,597,097 A | * | 8/1971 | Kellis | 401/6 |
| 4,078,865 A | | 3/1978 | Moser | |
| 4,135,274 A | | 1/1979 | Freeman | |
| 4,299,005 A | | 11/1981 | Brown | |
| 4,308,879 A | | 1/1982 | Thornbloom | |
| 4,396,028 A | | 8/1983 | Waggoner | |
| 4,883,380 A | | 11/1989 | Ritterman | |
| 4,961,661 A | | 10/1990 | Sutton et al. | |
| 5,088,849 A | | 2/1992 | Johnson et al. | |
| 5,125,757 A | | 6/1992 | Morrison et al. | |
| 5,353,819 A | | 10/1994 | Kahn et al. | |
| 5,360,111 A | | 11/1994 | Arispe | |
| 5,568,669 A | | 10/1996 | Godown | |
| 5,573,342 A | | 11/1996 | Patalano | |
| 5,699,574 A | | 12/1997 | Oviatt | |
| D394,328 S | | 5/1998 | Palumbo | |
| 5,846,011 A | | 12/1998 | Bernstein et al. | |
| 5,931,591 A | * | 8/1999 | McCracken | 401/6 |
| 5,934,296 A | * | 8/1999 | Clay | 132/320 |
| 6,010,264 A | * | 1/2000 | Scuderi et al. | 401/21 |

* cited by examiner

*Primary Examiner*—Todd E. Manahan
*Assistant Examiner*—David C. Comstock
(74) *Attorney, Agent, or Firm*—Hughes & Kaplan; Barry E. Kaplan, Esq.

(57) ABSTRACT

A fluid applicator having a telescoping handle and an applicator assembly. The applicator assembly comprises a casing, a cavity, an inner plate, an outer plate, a sponge, and a cover. The inner plate is positioned adjacent to the cavity area, with the outer plate adjacent to and in contact with the inner plate. The sponge is attached to the outer plate and extends beyond the casing to allow sponge-to-skin contact. The inner plate is slidably engaged by the casing; thus, allowing the inner plate to be slid between open and closed positions. The inner plate and the outer plate have a plurality of through-holes formed therethrough. When the inner plate is in the closed position, the through-holes of the inner plate do not align with the through-holes of the outer plate; thus, preventing the flow of liquid from the cavity to the sponge. To allow the filling of the cavity, an aperture is formed through the casing, and a cap is provided to seal the aperture. In an alternative embodiment, the through-holes of the outer plate are graduated in increasing diameter in order to optimize fluid flow through the device.

8 Claims, 3 Drawing Sheets

FLUID APPLICATOR

RELATED APPLICATIONS

The inventor hereof claims priority based upon and pursuant to U.S. provisional patent application serial No. 60/140,384 filed on Jun. 22, 1999.

TECHNICAL FIELD

The present invention relates generally to fluid applicators; and, more specifically, to compact applicators for applying lotion or oil to a portion of the body.

BACKGROUND ART

While engaging in outdoor activities wherein one expects to spend substantial time in the sun, it is often necessary or desirable to apply lotion or oil to his or her body, or to that of another. There are, however, for most people, specific locations on the body that are difficult to reach, for instance the middle and upper back. Moreover, many people find it undesirable to use their hands as a mechanism for application of lotion or oil. This is so especially under circumstances wherein washing facilities are unavailable, and their lotion or oil coated hands may come into contact with sand or the like, and subsequently into contact with their eyes, eyeglasses, food, or other objects.

In recognition of these difficulties, a number of lotion applicators having extended or extensible handles have been proposed. Examples of such devices may be found by reference to the following U.S. Patents: U.S. Pat. No. 1,973,768 to Knapp; U.S. Pat. No. 3,103,682 to Markle; U.S. Pat. No. 4,078,865 to Moser; U.S. Pat. No. 4,299,005 to Brown; U.S. Pat. No. 4,308,879 to Thornbloom; U.S. Pat. No. 4,396,028 to Waggoner; U.S. Pat. No. 5,360,111 to Arisp; U.S. Pat. No. 5,568,669 to Godown; and, U.S. Pat. No. 5,699,574 to Oviatt.

In U.S. Pat. No. 3,103,682 to Markle is disclosed a lotion applicator having a sponge-type applicator pad. The pad is affixed, via a bracket, to a plurality of telescoping handle portions. The telescoping handle portions are received within the bracket as the handle is collapsed to its closed position. This device, however, provides no means for containing a supply of lotion or oil and for transmitting that supply to the applicator pad. Rather, a separate container is provided that may be housed in the handle portion and secured in place by a screw-type closure element. The container must be removed from the applicator device by user, opened, and the lotion or oil manually applied to the applicator pad.

U.S. Pat. No. 5,088,849 to Johnson et al. provides a telescoping applicator that is useful for dispensing liquids and applying them to the body. In this device, dual chambers are provided for liquid storage, and the contents of either chamber may be dispensed, at the selection of the user, by way of a pump to a distributor disk and sponge arrangement. This device, however, is complex in its configuration and bulky to use and store.

U.S. Pat. No. 5,125,757 to Morrison et al. describes a combination dispenser-applicator having a ball applicator assembly on one side, and a sponge applicator upon the other. A fluid reservoir is disposed between the two sides. In operation, the fluid reservoir supplies the fluid to the user's skin through the ball applicator assembly. The user then reverses the device and uses the sponge applicator to spread the fluid along her body. This device, like Johnson et al.'s device previously described, is complex in its configuration, and bulky to use and store.

Although each of the above-referenced devices is novel in its arrangement, none provide a fluid applicator having means for storing and dispensing a fluid through a gravitationally advantaged system of offsetting through-holes, the through-holes being opened and closed, and the fluid being, thus, controlled, through a sliding plate arrangement.

It is readily apparent that a new and improved fluid applicator is needed that comprises a telescoping handle to assist the user in reaching difficult body locations, and that further comprises a dual plate fluid control system having a plurality of offsetting through-holes to regulate the flow of fluid. All of these features are provided in an advantageously slim and compact form. It is, therefore, to the provision of such a device that the present invention is directed.

BRIEF SUMMARY OF THE INVENTION

Briefly described, in a preferred embodiment, the present invention provides a fluid applicator having a telescoping handle and a novel applicator assembly. More specifically, the applicator assembly comprises a casing having an outer plate with a plurality of holes formed therein, a cavity, an inner plate having a plurality of holes formed therein, an applicator element, and a cover. Although the applicator element may be a sponge, a pad, or the like, a sponge is used herein as an exemplary applicator element. All of these features are provided in an advantageously slim and compact form.

The inner plate is slidably engaged and constrained by the casing; thus, the inner plate selectively may be disposed between open and closed positions adjacent the cavity area, with the outer plate being adjacent to and in contact with the inner plate in its closed position. The sponge is affixed to the outer plate and extends beyond the casing to allow sponge-to-skin contact.

The inner plate and the outer plate have a plurality of through-holes formed therein; however, when the inner plate is in the closed position, the through-holes of the inner plate do not align with the through-holes of the outer plate. This novel configuration, thus, prevents the flow of liquid from the cavity to the sponge when the device is in its closed position. To allow the fluid to flow through the device, the user simply pulls on an exposed lip, or tab, of the inner plate. When the device is, thus, fully or partially opened, the through-holes of the inner plate align with the through-holes of the outer plate, allowing the flow of fluid to the sponge.

As an added protection against leakage and/or inadvertent contact with a dampened sponge, a cover is provided that is dimensioned to fit over the sponge and snugly engage the casing. To allow the convenient filling of the cavity, an aperture is formed through the casing wherein a plug or a cap is provided to seal the aperture.

In an alternate embodiment, the diameters of the through-holes formed in the outer plate are graduated such that through-holes positioned toward the distal end of the outer plate have larger diameters than do those at the proximal end. That is, the diameters of the through-holes decrease as they approach the proximal end. This is advantageous when the invention is to be utilized by an individual for self-applications to her back. When so used, the proximal end of device generally will be the lowest point. As such, fluid within the cavity and the sponge is gravitationally advantaged to that end. By utilizing larger diameter through-holes near the distal end, more fluid will flow into the sponge through the outer plate at the distal end; thus, allowing the fluid to flow toward the proximal end of the sponge when that end of the device is lowered. This arrangement is advantageous in that a more even distribution of the fluid within the sponge is provided, while preventing undesirable saturation of the sponge at the proximal end. The through-holes of the inner plate similarly may be modified to optimize the flow of the fluid to meet these criteria.

Thus, as described in summary form, the following objects, features, and advantages are provided by the present invention, comprising, in part:

- a new and improved fluid applicator having a telescoping handle;
- a new and improved fluid applicator having a dual plate flow control system wherein a plurality of through-holes in each plate are offset such that the through-holes are not aligned when the device is in the closed position, thus preventing fluid flow, and wherein the through-holes are aligned when the device is in the open position, thus allowing fluid flow;
- a new and improved fluid applicator having a cavity for storing lotions or oils, and a means for refilling said cavity;
- a new and improved fluid applicator having an applicator element portion, as a sponge or the like, for applying fluid to a body;
- a new and improved fluid applicator that can be compressed into a thin and compact unit;
- a new and improved fluid applicator having a plurality of through-holes wherein the diameter of the through-holes are graduated in increasing size toward its distal end, such that when the device is lowered toward the inverted position, more fluid will flow to the sponge through through-holes having larger diameters positioned near the distal end; thus, allowing the fluid to flow through the sponge toward its proximal end and, thereby, minimizing undesirable saturation of the sponge at that end.

These and other objects, features, and advantages of the present invention will become more apparent to one skilled in the art from the following description and claims when read in light of the accompanying Figures.

BRIEF DESCRIPTION OF THE DRAWINGS

The present invention best will be understood through consideration of, and reference to, the following drawing Figures, viewed in conjunction with the Detailed Description of the Preferred Embodiment referring thereto, in which like reference numbers throughout the various Figures designate like structure and in which.

As the reader doubtless will realize, the invention is susceptible of other and different embodiments, and its several details are capable of modifications in various obvious respects, all without departing from the scope of the invention. Accordingly, the Figures and the descriptions referring thereto are to be regarded as only illustrative in nature, and not as restrictive.

DETAILED DESCRIPTION OF THE PREFERRED EMBODIMENT

In describing preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

Figures 1, 2:
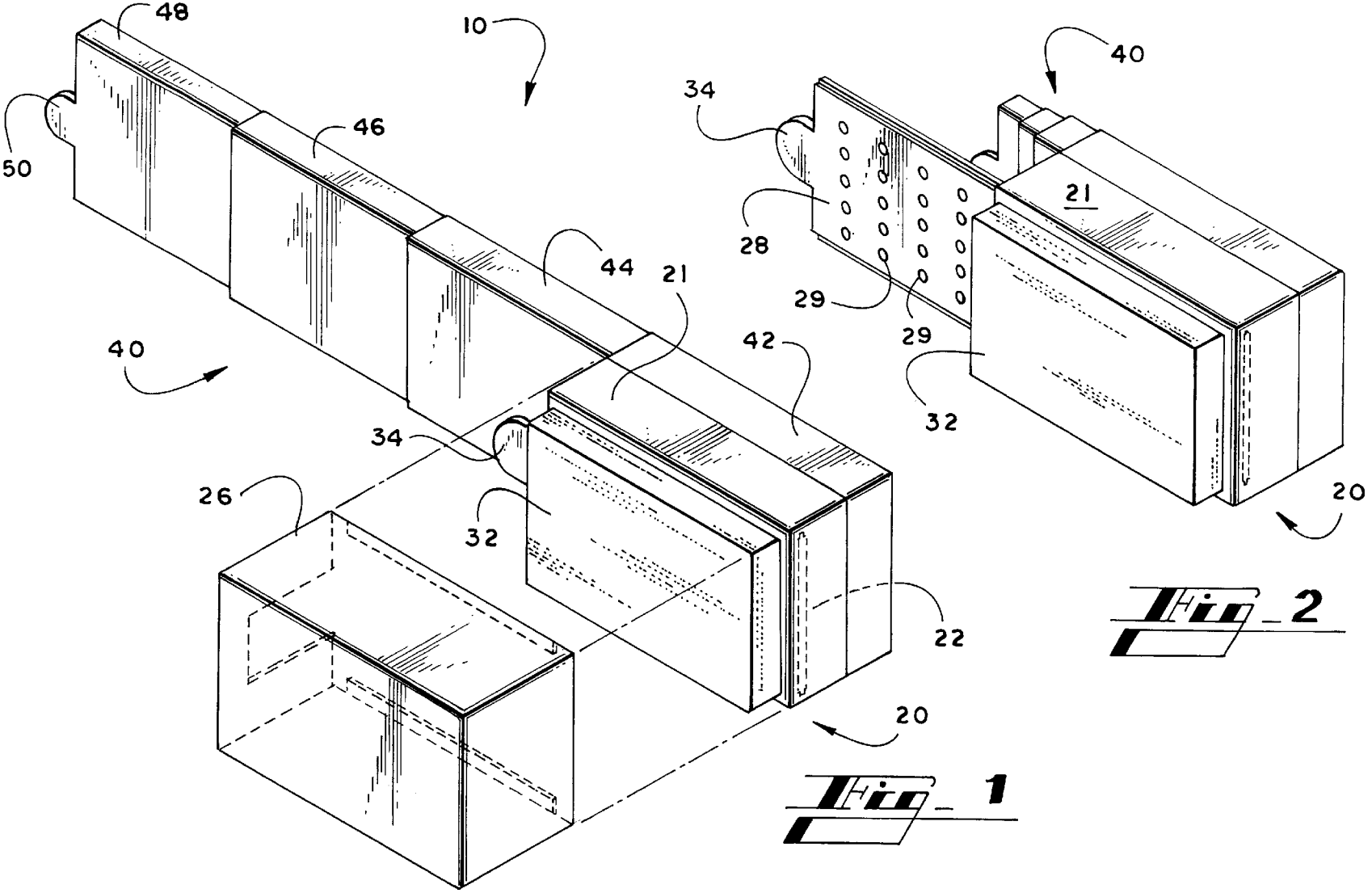
FIG. 1 is a partially exploded perspective view according to a preferred embodiment of a device of the present invention with extended handle and in a position closed to fluid flow.
FIG. 2 is a perspective view according to a preferred embodiment of a device of the present invention with partially collapsed handle and in a position opened to fluid flow.
Figure 3:
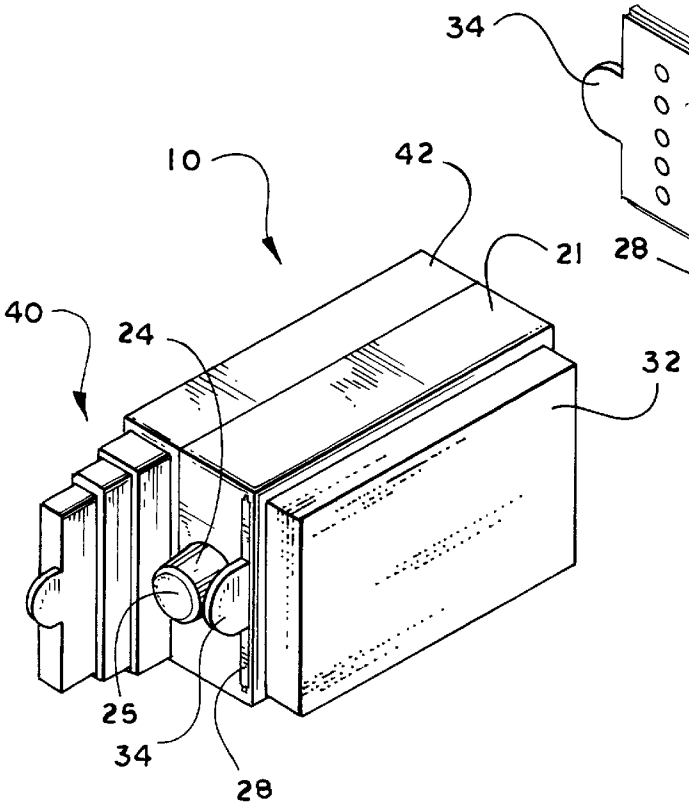
FIG. 3 is a perspective view from a second viewing angle according to a preferred embodiment of a device of the present invention.
Figure 5:
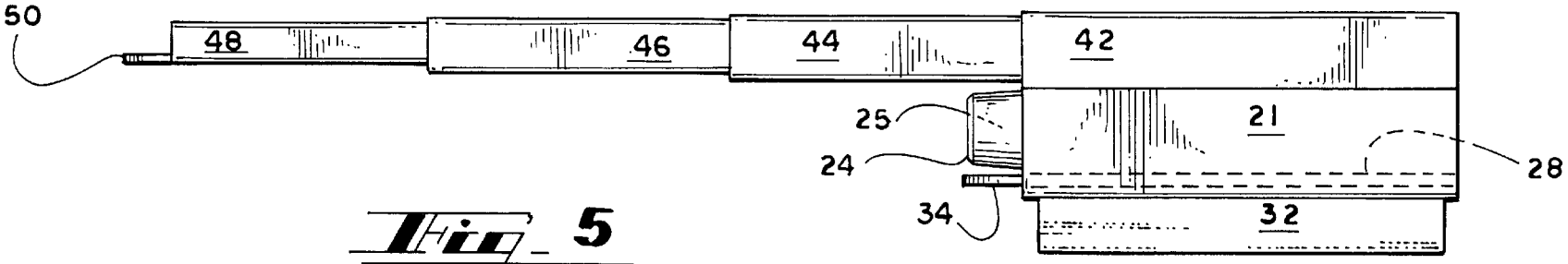
FIG. 5 is a side view according to a preferred embodiment of a device of the present invention with extended handle and in a position closed to fluid flow; and, FIG. 6 is a front view according to a preferred embodiment of a device of the present invention with extended handle and in a position closed to fluid flow.
Figure 6:
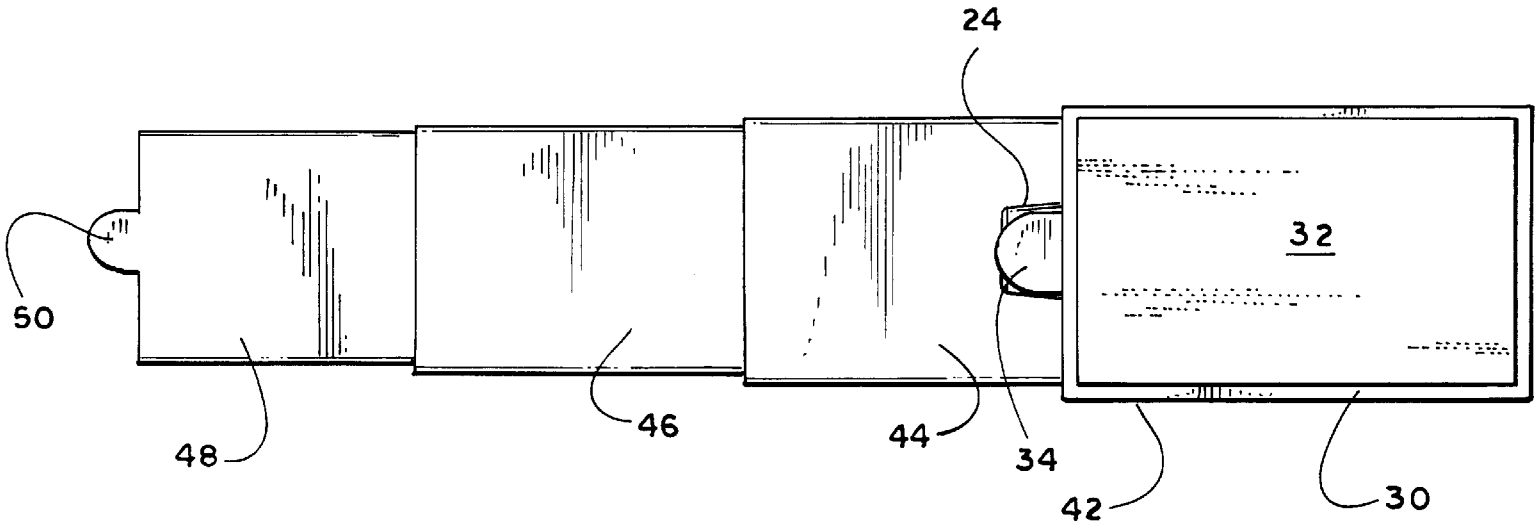

Referring now to FIGS. 1–3, device 10 generally comprises applicator assembly 20 and extension handle 40. More specifically, extension handle 40 preferably comprises four slidably engaged telescoping rectangular boxed-shaped sections 42, 44, 46, 48. Each of the telescoping sections 42, 44, 46, 48 are dimensioned such that section 44 telescopes within section 42, section 46 telescopes into section 44, and section 48 telescopes into section 46. In other words, the height and width of section 42 is slightly larger than that of 44; the height and width of section 44 is slightly larger than that of 46; and, the height and width of section 46 is slightly larger than that of 48. When extension handle 40 is in the unextended position, sections 44, 46 and 48 are telescoped within section 42. A tab 50 is provided for the user's convenience in extending and collapsing handle 40.

It will be recognized by one skilled in the art that internal stop members (not shown) may be provided to prevent sections 42, 44, 46, 48 from disengaging from each other. In such instance, the internal stop members preferably are positioned at the distal ends of sections 42, 44 and 46 in a manner well known in the art. Such stop members may be conveniently formed to contact internal protrusions formed at the proximal ends of sections 44, 46 and 48. According to this configuration, further extension and separation of the sections, thus, is prevented when sections 42, 44, 46, 48 have been extended to their maximal lengths. Alternatively, sections 42, 44, 46, 48 may be provided with tapering profiles, of design well known in the art, in order to frictionally engage and, thus, prevent separation when in fully extended position.

It similarly will be recognized that a snap-lock mechanism comprising dimple and protrusion type elements (not shown) might be positioned internal to each section of handle 40, such that the respective protrusion releasably engages a corresponding dimple when that section is fully extended. Such protrusions might be formed on the proximal ends of sections 44, 46 and 48, and corresponding dimples formed on the distal ends of sections 42, 44 and 46. In such configuration, when handle 40 is in the fully extended position, protrusion of section 44 engages dimple of section 42; protrusion of section 46 engages dimple of section 44; and protrusion of section 48 engages dimple of section 46. The application of a slight compression hand force will disengage the respective protrusions from the respective dimples; thereby, allowing section 42, 44, 46, 48 to telescope into a compact unit.

Figure 4:
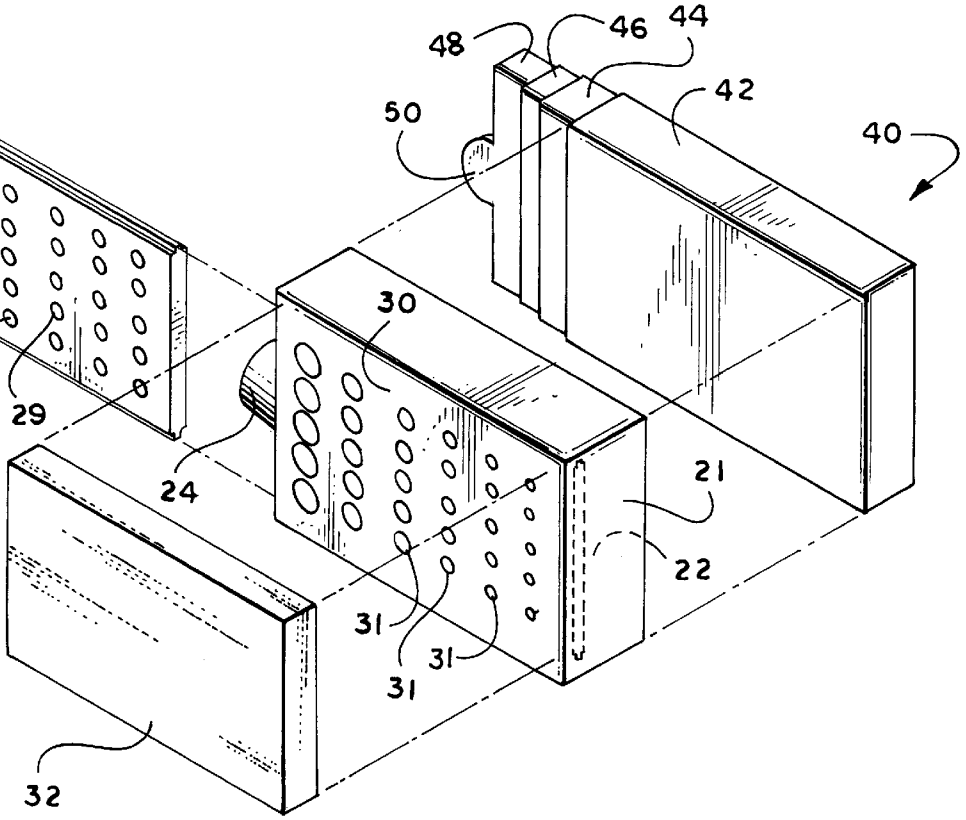
FIG. 4 is a partially exploded perspective view according to an alternative embodiment of a device of the present invention demonstrating details of the inner plate of the device, and further demonstrating the outer plate having varying fluid transmission through-hole sizes.

Best seen with reference to FIG. 4, applicator assembly 20 preferably is rectangular or box shaped, and is attached to one side of section 42 of extension handle 40. Applicator assembly 20 comprises, generally, casing 21 which surrounds cavity 22, fill cap 24, cover 26, inner plate 28, outer plate 30, and sponge 32. Casing 21 is adjacent to section 42, followed by inner plate 28, outer plate 30, and sponge 32. Outer plate 30 is adjacent to and in contact with inner plate 28 in its closed position. Sponge 32 is preferably glued or otherwise affixed to outer plate 30, and extends past casing 21 to allow direct contact to the skin. Although casing 21 is preferably rectangular in shape, it will be appreciated by those skilled in the art that casing 21 may be round, or may be provided in such alternate shapes as may be suitable to the user, all without departing from the scope of the present invention.

Cooperating portions of inner plate 28 and casing 21 preferably are formed with tongue and groove arrangement, that inner plate 28 may slidably engage casing 21. A seal (not shown) of type well known in the art may be provided to minimize the chance of leakage around inner plate 28.

With continued reference to FIG. 4, inner plate 28 and outer plate 30 have a plurality of through-holes 29 and 31, respectively, formed therethrough to allow the lotion or oil to flow from cavity 22 to sponge 32. Through-holes 31 of outer plate 30, however, are offset from through-holes 29 of inner plate 28 such that when inner plate 28 and outer plate 30 are aligned, the respective through-holes 29 and 31 are not aligned. In this manner, fluid flow to sponge 32 is prevented.

Because inner plate 28 is slidably engaged within casing 21, tab 34 is formed at one of the ends of inner plate 28 and extends to the exterior of casing 21. In use, tab 24 is pulled to slide inner plate 28 until through-holes 29 are aligned with through-holes 31, thereby allowing fluid to flow therethrough to sponge 32. Alternatively, inner plate 28 may be slid to an intermediate position such that through-holes 29 and 31 are partially aligned; thus, allowing a reduced amount of fluid to flow.

A cover 26 is provided as an additional closing means, to prevent undesired seepage and exposure to a moist sponge 32. Preferably, cover 26 is dimensioned to fit over sponge 32 and snugly secure around casing 21.

Shown in FIG. 4 is an alternate embodiment of the device of the present invention. In this embodiment, the diameters of through-holes 31 formed in the outer plate 30 are graduated such that through-holes positioned toward the distal end of the outer plate 30 have larger diameters than do those at the proximal end. That is, the diameters of the through-holes decrease as they approach the proximal end. Because device 10 will likely be utilized by an individual for self-applications to her back, the proximal end of device 10 will generally be the lowest point. As such, fluid within cavity 22 and the sponge 32 is gravitationally advantaged to the proximal end. By utilizing larger diameter through-holes near the distal end, more fluid will flow into the sponge through the outer plate 30 at the distal end; thus, allowing the fluid to flow toward the proximal end of sponge 32 when that end is lowered. This is advantageous in that a more even distribution of the fluid within sponge 32 is provided, while preventing undesirable saturation of the sponge 32 at its proximal end. It will be recognized by those skilled in the art that the through-holes 29 of inner plate 28 similarly may be modified to optimize the flow of the fluid to meet these considerations.

In order to provide for ease in filling or draining cavity 22, an aperture 25 is formed in casing 21 and in fluid communication with cavity 22. Fill cap 24 is provided to fit snugly over aperture 25, as via mating screw threads, so that leakage is prevented.

It should be noted that telescoping sections may be added or omitted from extension handle 40, as required for proper length and operation of the device 10. It also will be apparent to one skilled in the art that a multitude of snap-fit or other securing means may be utilized for positively engaging or locking the telescoping sections of extension handle 40 into preferred position.

Although a sponge is specified in the exemplary embodiments discussed hereinabove, other fluid absorbing materials such as cloth may be utilized. It similarly will be recognized by those skilled in the art that sponges and other forms of applicator pads have varying pore sizes and wicking rates, and, therefore, varying rates of fluid absorption and transmission. Such pads, therefore, may tend to absorb and transmit the lotion or oil at an undesirable rate. In recognition of this characteristic, an applicator element may be provided having either a varying density, as by selectively bonding adjacent pads having differing fluid absorption and transmission characteristics, or by providing an applicator backing element adjacent through-holes 31 for altering the rate of fluid transmission to the applicator element. In the later case, a backing element may be provided having either a coating applied thereto, or a fiber matrix selected for its fluid transmission properties, for providing favorable fluid flow characteristics to and through the applicator element.

Although device 10 has been described in a configuration that is conveniently filled and refilled by the user, it should be apparent that the device might be provided in pre-filled and/or disposable form without departing from the scope of the invention.

The above detailed description of preferred and alternative embodiments have been provided for exemplary purposes only and are not meant, nor should they be read, to limit the scope or spirit of the present invention; rather, the invention hereof is limited only by the appended claims.

What is claimed is:

1. An applicator for applying fluids to the skin of a human body comprising:

a handle;

a casing carried by said handle, said casing comprising a cavity for retaining fluid and a means for filling said cavity, said casing further comprising an outer plate having a plurality of holes therethrough;

an inner plate slideably engagable within said casing between a first position and a second position, said inner plate comprising a plurality of holes therethrough, said inner plate being in proximal relationship with said outer plate wherein said plurality of through-holes of said outer plate are not aligned with said plurality of through-holes of said inner plate when said inner plate is in said first position, thus impeding fluid flow from the cavity, and wherein said plurality of through-holes of said outer plate align with said plurality of through-holes of said inner plate when said inner plate is in said second position, thus allowing fluid flow from the cavity;

said plurality of through-holes in one of said plates further comprising rows of holes, said rows of holes increasing in diameter according to row; and, an applicator carried by said outer plate.

2. The fluid applicator of claim 1, wherein said handle comprises a telescoping handle operable between extended and collapsed positions.

3. The fluid applicator of claim 2, wherein said telescoping handle is contained substantially within said casing when said handle is in collapsed position.

4. The fluid applicator of claim 1, further comprising an applicator cover.

5. The fluid applicator of claim 1, wherein said cavity filling means comprises an aperture and cap.

6. The fluid applicator of claim 1, wherein said applicator comprises an absorbent material.

7. An applicator for applying fluids to the skin of a human body comprising a telescoping handle operable between extended and collapsed positions; a casing carried by said handle, said casing comprising a cavity for retaining fluid and a means for filling said cavity, said casing further comprising an outer plate having a plurality of holes therethrough; an inner plate slideably engagable within said casing between a first position and a second position, said inner plate comprising a plurality of holes therethrough, said inner plate being in proximal relationship with said outer plate wherein said plurality of through-holes of said outer plate are not aligned with said plurality of through-holes of said inner plate when said inner plate is in said first position, thus impeding fluid flow from the cavity, and wherein said plurality of through-holes of said outer plate align with said plurality of through-holes of said inner plate when said inner plate is in said second position, thus allowing fluid flow from the cavity; said plurality of through-holes in one of said plates further comprising rows of holes, said rows of holes increasing in diameter according to row; and, an absorbent applicator carried by said outer plate.

8. The fluid applicator of claim 7, wherein said telescoping handle is contained substantially within said casing when said handle is in collapsed position.

* * * * *